United States Patent [19]

Crandell

[11] Patent Number: 4,738,065

[45] **Date of Patent: * Apr. 19, 1988**

[54] CURTAINWALL SYSTEM

[75] Inventor: Stephen L. Crandell, Gibsonia, Pa.

[73] Assignee: PPG Industries, Inc., Pittsburgh, Pa.

[ * ] Notice: The portion of the term of this patent subsequent to Oct. 1, 2002 has been disclaimed.

[21] Appl. No.: 345

[22] Filed: Jan. 2, 1987

Related U.S. Application Data

[60] Continuation of Ser. No. 749,234, Jun. 27, 1985, Pat. No. 4,633,631, which is a division of Ser. No. 572,328, Jan. 20, 1984, Pat. No. 4,543,755.

[51] Int. Cl.[4] ..... E04B 2/88

[52] U.S. Cl. ..... 52/235; 52/510; 52/512

[58] Field of Search ..... 52/235, 309.7, 511, 52/481, 512, 510, 544, 546, 549, 297, 403

[56] References Cited

U.S. PATENT DOCUMENTS

| | | | |
|---|---|---|---|
| 2,145,469 | 1/1939 | Weinland | 52/403 |
| 3,082,848 | 3/1963 | Keller | 52/235 |
| 3,251,168 | 1/1967 | Waring | 52/235 |
| 3,295,282 | 1/1967 | Belcher | 52/460 |
| 3,559,358 | 2/1971 | Lohse | 52/379 |
| 3,672,107 | 6/1972 | Santry | 52/235 |
| 3,712,016 | 1/1973 | Reeve | 52/741 |
| 3,715,848 | 2/1973 | Jordan | 52/408 |
| 3,735,544 | 5/1973 | Longinotti | 52/235 |
| 3,936,986 | 2/1976 | Steel | 52/235 |
| 3,967,424 | 7/1976 | Gates | 52/511 |
| 3,978,633 | 9/1976 | Scheidler | 52/511 |
| 4,015,388 | 4/1977 | Hemminger | 52/395 |
| 4,056,904 | 11/1977 | Dawdy | 52/127.3 |
| 4,070,835 | 1/1978 | Revérend | 52/94 |
| 4,089,146 | 5/1978 | Martinez | 52/484 |
| 4,107,887 | 8/1978 | Wendt | 52/105 |
| 4,307,551 | 12/1981 | Crandell | 52/235 |
| 4,324,373 | 4/1982 | Zibritosky | 52/397 |
| 4,370,838 | 2/1983 | Vermillion | 52/36 |
| 4,372,901 | 2/1983 | Kim | 52/309.7 |
| 4,448,001 | 5/1984 | Whitmyer | 52/209 |
| 4,483,122 | 11/1984 | Crandell | 52/235 |
| 4,545,161 | 10/1985 | Baumann | 52/235 |
| 4,581,868 | 4/1986 | McCann | 52/235 |
| 4,625,481 | 12/1986 | Crandell | 52/235 |

FOREIGN PATENT DOCUMENTS

| | | | |
|---|---|---|---|
| 2216214 | 10/1973 | Fed. Rep. of Germany | 52/235 |
| 2738748 | 1/1979 | Fed. Rep. of Germany | 52/235 |
| 1014857 | 12/1965 | United Kingdom | 52/235 |
| 2126620 | 7/1983 | United Kingdom . | |

OTHER PUBLICATIONS

"Qasal ® Exterior Building Panels" Glasweld, Sweets Architectural Catalog File 7.51GLa.

Kawneer drawings. SK-1 through SK-5.

Advertisement from Alumiline, 3500 Series Structural Glazing.

"Architectural Glazing", Architectural Division of Lord & Burnham Company, Limited.

Kawneer Product Bulletin 84-DP-19, Oct. 31, 1984.

Sheet of design drawing.

Kawneer (detail drawing dated 9/28/83).

Glass Digest, New Products, Aug. 15, 1986, p. 8.

U.S. Glass, Metal & Glazing (?), p. 12.

*Primary Examiner*—Henry E. Raduazo

*Attorney, Agent, or Firm*—Donald Carl Lepiane

[57] ABSTRACT

This invention relates to a curtainwall system having panels mounted on a grid formed of vertical and horizontal mullions having a planar or flat exterior surface. Each of the panels is provided with a frame formed of hanger sections having a groove facing the interior of the frame. A panel engaging clip has one end inserted in the groove of the hanger frame and the other portion of the clip secured to the grid. The clip urges the hanger against the weatherstripping of the grid to provide an air and dust tight seal. A polyurethane block is mounted in the space between adjacent panels and thereafter a silicone is extruded into the space.

5 Claims, 4 Drawing Sheets

CURTAINWALL SYSTEM

This is a continuation of application Ser. No. 749,234, filed June 27, 1985 now U.S. Pat. No. 4,633,631 which is a division of application Ser. No. 572,328, filed Jan. 20, 1984, now U. S. Pat. No. 4,543,755.

BACKGROUND OF THE INVENTION

1. Field of the Invention

This invention relates to a curtainwall system having mullions arranged to form a grid and panels mounted over the openings of the grid and secured in position from within the building.

2. Discussion of the Technical Problems

U.S. Pat. No. 4,307,551 and U.S. patent application Ser. No. 311,822 filed Oct. 16, 1981 in the name of Stephen L. Crandell and entitled REPLACEMENT PANEL AND METHOD OF INSTALLING SAME IN CURTAINWALL teach a curtainwall for covering walls of a building to provide the building with a new exterior. In general the panels of the curtainwall use internal panel clips and silicone adhesive between the panels. No other exterior arrangement other than the silicone adhesive is used to secure the panels in position. With this arrangement the curtainwall has a substantially flat exterior surface. Although the curtainwall taught in the above-mentioned patent and patent application is ideal for cladding existing building walls, it is not designed to be a complete wall for a building. For example, the curtainwall taught in the above-mentioned patent and patent application rely on silicone adhesive to act as a seal to prevent the ingress of moisture and dust. Although a silicone seal is acceptable for a curtainwall system that is mounted over an existing wall of the building, it is not acceptable for use as a complete wall system for a building.

As can be now appreciated it would be advantageous to provide a curtainwall having panels providing a flat or planar exterior surface that is the complete wall system for a building.

SUMMARY OF THE INVENTION

This invention relates to a panel for a curtainwall of a building which panel includes a glazing sheet having hanger sections arranged to form a frame. The frame is mounted on the surface of the sheet facing the building interior. In the preferred embodiment the hanger sections each have a groove facing the frame interior with the ends overlayed with a moisture resistant sealant to provide a moisture and dust resistant frame on the rear surface of the panel.

This invention also relates to a curtainwall for a building which includes a plurality of vertical mullions and a plurality of horizontal mullions each having a panel support flange having panel supporting surface. The horizontal mullions and vertical mullions are mounted in a fixed relationship to one another to provide a grid having openings with the panel supporting surfaces preferably lying substantially in a flat or planar surface. A panel to be mounted over an opening in the grid includes a frame made of hanger sections mounted on the surface of the panel to face the building interior. A panel clip has one portion engageable with a groove of the frame and the other portion detachably secured to the grid. In the preferred embodiment, the hanger sections have a C-shaped cross-section having a first leg inserted in the hanger frame and a second leg overlying the panel supporting surface. A bolt passes through the second leg of the panel clip bottoming out of the panel support flange. Rotating the bolt in a first direction biases the frame of the panel against weatherstripping between the panel support surface and the hanger frame to form a dust and air tight seal. The panels may be mounted on the grid from the building interior and the exterior of the curtainwall finished at a later date. The curtainwall is finished or dressed by inserting a polyurethane plug between the space between edge portions of adjacent panels and thereafter flowing a silicone adhesive into the space.

DETAILED DESCRIPTION OF THE INVENTION

Figure 1:
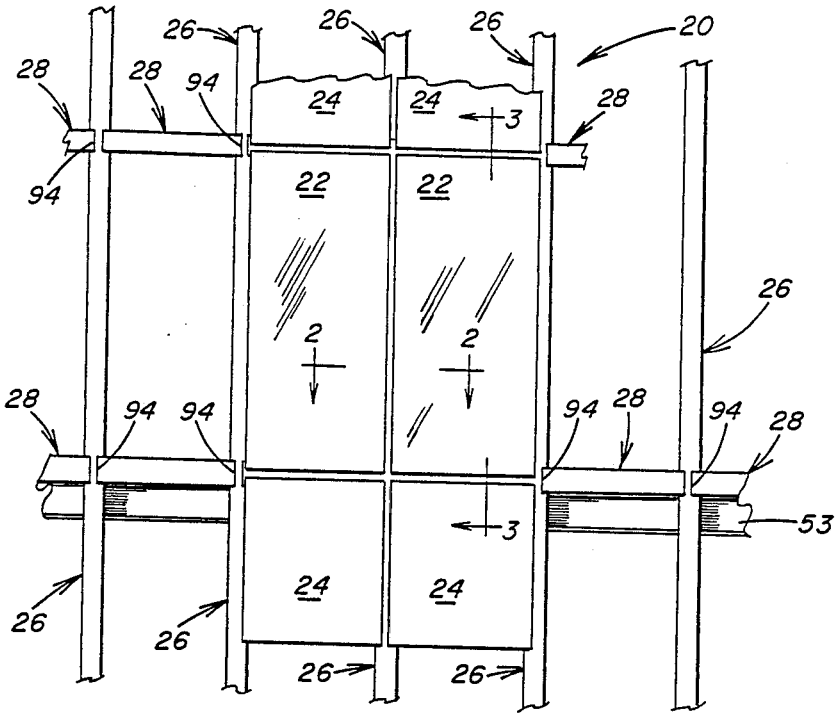
FIG. 1 is a fragmented front view of a building under construction illustrating the arrangement of mullions and panels of the curtain wall of the instant invention.

Shown in FIG. 1 is an external view of a building under construction partially clad with curtainwall 20 of the instant invention. In general, and with reference to FIGS. 1–3, the curtainwall 20 includes vision panels 22 and spandral panels 24 secured to vertical mullions 26 by panel clips 27 and to horizontal mullions 28 by panel clips 30 (panel clips 27 and 30 shown in FIGS. 2 and 3).

Figure 2:
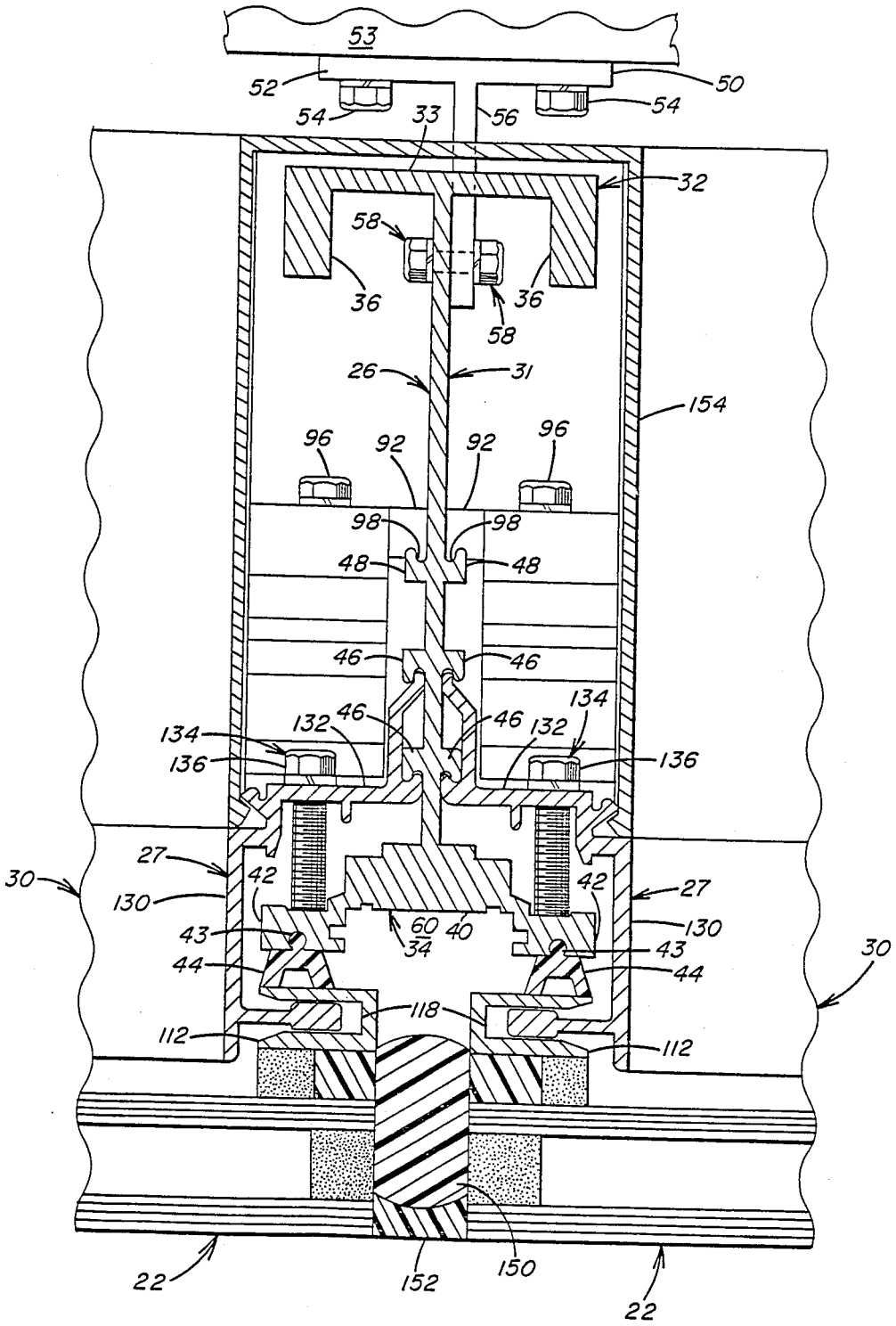
FIG. 2 is a fragmented plan view in cross-section taken along lines 2,2 of FIG. 1 and having portions removed for purposes of clarity.

Referrring now to FIG. 2, the vertical mullion 26 is made of aluminum and has a generally "I" shaped cross-section having a central body portion 31, a structural flange 32 at one end and a panel engaging flange 34 at the other end. The design of the structural flange 32 is not limiting to the invention and is employed to reinforce the vertical mullion 26 making it structurally stable against windloads. In practice, and as shown in FIG. 2, the structural flange 32 has a "C" shaped cross-section. The outer legs 36 of the flange 32 each have a thickness of about ½ inch (1.27 centimeters) and a width of about ⅝ inch (1.60 centimeters) and a center section 38 having a width of about 2 inches (5.08 centimeters) and a thickness of about ⅛ inch (0.32 centimeters). The design of the panel engaging flange 34 is not limiting to the invention and is employed to reinforce the vertical mullion 26 to make it structurally stable against wind loads and to provide a panel engaging surface. The panel engaging flange 34 includes a center body portion 40 having a pair of extensions or panel supporting members 42 each having a groove 43 for capturing a weatherstrip 44 as shown in FIG. 2. The cross-sectional area of the panel engaging flange 34 and structural flange 32 are approximately equal to balance the weight of the vertical mullion 26. The central body portion 31 of the vertical mullion 26 has a thickness of about ⅛ inch (0.32 centimeters). On each side of the body portion 31 as viewed in FIG. 2 is a pair of spaced clip engaging feet 46 and a mullion joiner foot 48.

The vertical mullions 26 are secured to the building proper in any convenient manner. For example, and with continued reference to FIG. 2, an anchor 50 has a plate 52 secured to the building floor 53 by bolt and lock washer assemblies 54. A flange 56 extends from the plate 52, passes through a hole (not shown) cut into the structural flange 32 and has its end portion secured to the central body portion 31 of the vertical mullion 26 by a nut, bolt and washer assembly 58 of the type taught in U.S. Pat. No. 4,307,551 which teachings are hereby incorporated by reference.

The length of the vertical mullions 26 are not limiting to the invention. In the instance where vertical mullion sections are required to span the front of the building under construction, it is recommended that the vertical mullion sections terminate at the approximate center of a panel. Adjacent ends of the vertical mullion sections are conveniently joined, for example, and not limiting to the invention, by a C-shaped mullion splice (not shown) positioned over the structural flange 32 of adjacent ends of vertical mullion sections. A bar mullion splice (not shown) is mounted in cavity 60 of adjacent vertical mullion sections. The cavity 60 is between extensions 42 of the panel engaging flange 34. The mullion splices are preferably welded or screwed in position.

Figure 3:
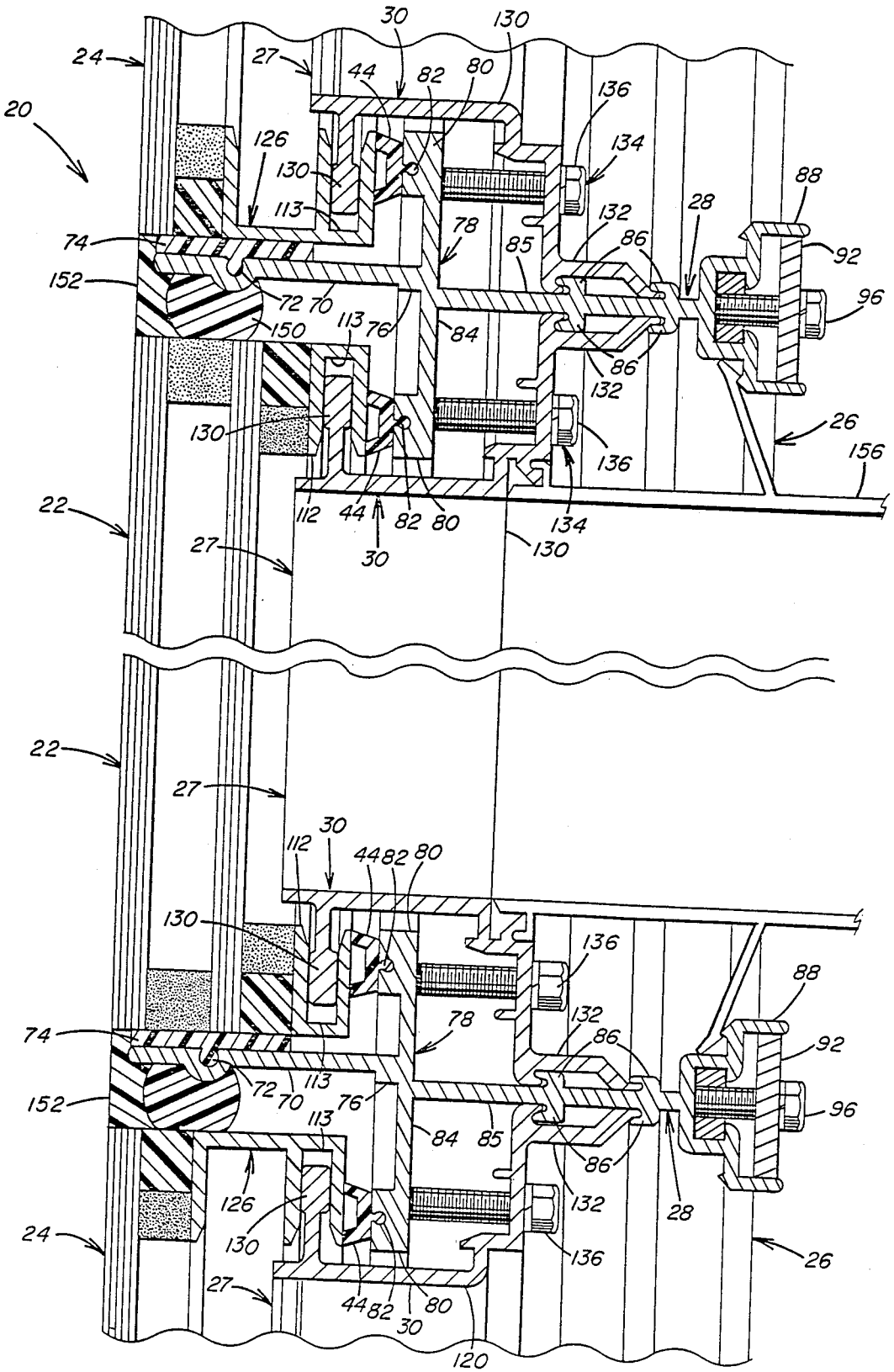
FIG. 3 is a fragmented plan view in cross-section taken along lines 2,2 of FIG. 1 and having portions removed for purposes of clarity.

With reference to FIG. 3, the discussion will now be directed to the horizontal mullions 28. Each of the horizontal mullions 28 include a panel supporting ledge 70 having a groove 72 for capturing setting block 74 as shown in FIG. 3. The ledge 70 has a thickness of about ⅛ inch (0.32 centimeter) and a width such that the ledge terminates short of the outer panel surface as shown in FIG. 3. The ledge 70 is joined at 76 to panel engaging flange 78. The ledge 70 has increased thickness at 76 to prevent bending of the ledge 70. The panel engaging flange 78 has extensions or panel supporting members 80 each having a groove 82 for capturing weather stripping 44 as shown in FIG. 3. Center portion 84 of the panel engaging flange 78 has a thickness of about ⅛ inch (0.32 centimeter) and a length of about 2 inches (5.08 centimeters). The panel supporting members 80 have a thickness of about ⅝ inch (1.60 centimeters). A central extension 85 having a thickness of about ⅛ inch (0.32 centimeter) and a length of about 3 inches (7.62 centimeters) extends from the panel engaging flange 78 as shown in FIG. 3. On each side of the central extension 85 is a pair of spaced clip engaging feet 86. The clip engaging feet 86 are similar to the clip engaging feet 46 of the vertical mullion 26 shown in FIG. 2. A bar receiving flange 90 having a wall thickness of about ⅛ inch (0.32 centimeter) is provided on the end of the center extension 85 for receiving a bar splice 92 in a manner to be discussed below.

The vertical mullions 26 and horizontal mullions 28 are joined in any convenient manner to form a grid having openings over which are positioned panels 22 and 24 in a manner to be discussed below. For example, and not limiting to the invention, a cut-out 94 (see FIG. 1) is made in the panel engaging flange 34 of the vertical mullion 26. An end of the horizontal mullion 28 is inserted in the cut-out 94 with the outer surface of panel supporting members 42 of the panel engaging flange 34 of the vertical mullion 26 (FIG. 2) and the outer surface of the panel supporting members 80 of the panel engaging flange 78 of the horizontal mullion 28 (FIG. 3) essentially in the same plane. The outer surface of the members 42 and 80 is that surface facing away from the building. The bar splice 92 has one end captured in the bar receiving flange 88 and conveniently secured in position by bolt and lock washer assembly 96, e.g., as shown in FIG. 3. The outer end of the bar splice 92 as shown in FIG. 2 has a groove 98 to interconnect the bar splice with the mullion joiner foot 48. The clip engaging feet 46 of the vertical mullion 26 and the clip engaging feet 86 of the horizontal mullion 28 are sized and arranged such that the feet 46 and 86 are aligned when the horizontal and vertical mullions are joined to form the grid.

Figure 5:
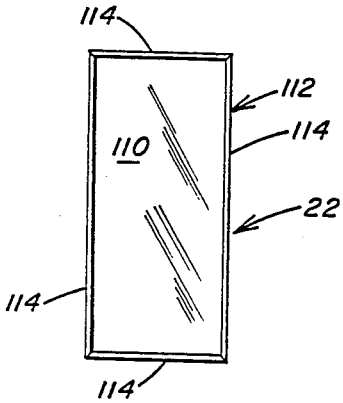
FIG. 5 is a rear view of a panel constructed in accordance with the teachings of the invention and illustrating hanger arrangement on the surface of the panel facing the building interior.
Figure 4:
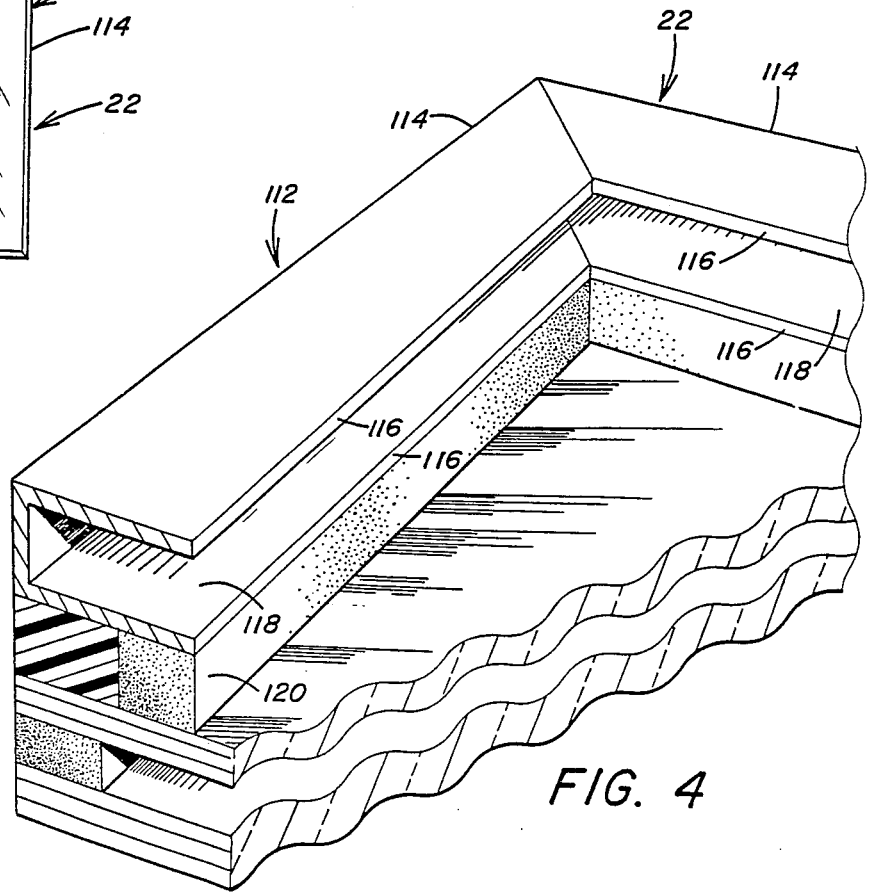
FIG. 4 is a fragmented sectional isometric view of a panel constructed in accordance with the teachings of the invention.

The discussion will now be directed to the vision panel 22 with the understanding that the discussion is applicable to the spandrel panel 24 unless indicated otherwise. With reference to FIGS. 4 and 5, the vision panel 22 includes a glazing sheet 100 having a frame 112 made of a hanger section 114 conveniently secured to the surface of the sheet 110 facing the building interior, i.e., the inside surface of the glazing sheet. Each of the hanger sections 114 are made of a length of U-shaped aluminum chanel having a wall thickness of about ⅛ inch (0.32 centimeter). Legs 116 of the hanger section 114 each have a width of about 1 inch (2.54 centimeters) and form a groove 118 having a width of about ½ inch (1.27 centimeters). The frame 112 is sized to have its outer peripheral surface portions generally flush with that of the sheet 110. The ends of the hanger sections 114 are preferably mitered and have a moisture resistant adhesive of the type taught in U.S. Pat. No. 3,791,910 which teachings are hereby incorporated by reference overlays the joint. The frame 112 is secured to the inside surface of the glazing sheet by tape 120 having adhesive on opposite surfaces and a silicone adhesive 122 in a manner taught in U.S. Pat. No. 4,307,551 which teachings are hereby incorporated by reference.

The glazing sheet 110 of the vision panel 22 is usually made of a transparent material for example, glass which may be coated or colored, The sheet may be a monolithic piece of glass or a pair of glass pieces joined together in any convenient manner to form a multiple-glazed unit of the type taught in U.S. Pat. Nos. 3,791,910 and 4,193,236 which teachings are hereby incorporated be reference. The glazing sheet 110 of the spandrel panel 24 is usually opaque to hide from view the floor and utility conduits of the building. The glazing sheet 110 of the spandrel panel 24 may be made of wood, metal or glass having an opaque coating, for example a ceramic coating. The glazing sheet 110 of the spandrel panel 24 may be a monolithic sheet or a double-glazed unit having at least one glass peice having an opaque coating. A combination of spandrel panel and vision panel that may be used in the practice of the invention is taught in U.S. Pat. Nos. 3,951,525 and 4,233,796 which teachings are hereby incorporated by reference.

When the glazing sheets 110 of adjacent panels have approximately equal thicknesses, the hanger sections 114 for the respective frames 112 are identical in construction. In the instance when the glazing sheets 110 have different thicknesses, the height of the hanger section is different so that the panels as mounted will provide a planar or flat exterior surface. For example and with reference to FIG. 3, the vision panel 22 has a double-glazed unit for a glazing sheet, whereas the spandrel 24 has a monolithic piece for a glazing sheet. The difference in thickness between the glazing sheet and spandel panels 24 and vision panel 22 is compensated for by a hanger section 126 having a W-shaped cross-section. The hanger section 126 is joined together to form a frame in the similar manner as the hanger sections 114 and the frame secured to the inner surface of the panel in any convenient manner, for example, as previously discussed for the frame 112.

The vision panels 22 and spandrel panel 24 are secured to the assembled mullions by the panel clips 27 and 30, respectively. The panel clips 27 and 30 are identical in construction and have a wall thickness of about ⅛ inch (0.32 centimeters) and as shown in FIG. 2 include a C-shaped section 130 and a bifurcated end portion 132. The C-shaped section 130 has an outer leg inserted in the groove 118 of the hanger frame 112 and the other outer leg overlying the panel engaging flange 34 (FIG. 2) or 78 (FIG. 3) as the case may be. The end of the C-shaped section 130 inserted in the groove 118 of the hanger 112 or 126 as the case may be, has a thickness of about ¼ inch (0.64 centimeter) for a snug, slideable fit. The bifurcated end portion 132 of the panel clip 30 engages the clip engaging feet 46 of the vertical mullion (FIG. 2) of the clip engaging feet 86 of the horizontal mullion (FIG. 3). Bolt 136 of bolt and lock washer assembly 134 passes through the leg of the panel clip overlying the panel engaging flange and bottoms out on the panel engaging flange as shown in FIGS. 2 and 3. Rotating the bolt in a first direction urges the bifurcated end portion 132 of the clip 30 into its respective clip engaging feet while urging or biasing the hanger 112 against the weatherstripping 44 to form an air and dust tight seal. The integrity of the seal is maintained by the application of the moisture resistant adhesive over the juncture of the hanger sections as was previously discussed.

In practice, the curtainwall of the instant invention is constructed in the following manner. A grid of the vertical and horizontal mullions is constructed in the manner previously discussed. Spandrel panels 24 and vision panels 22 are constructed and have a hanger frame 112 secured to inner surface of the panels 24 and 22 as previously discussed. A setting block 74 is mounted on the panel support ledge 70 and captured in the groove 72. Weatherstripping 44 is inserted in groove 43 of the panel engaging members 42 of the vertical mullions 26 and in the groove 82 of the panel support members 80. The panel is mounted in an opening with its bottom end supported on the setting block 74. A panel engaging clip 30 has its outer end inserted in the groove 118 of the hanger and the bifurcated end portion 132 inserted in the clip engaging feet 86 of the horizontal mullion which forms the bottom portion of the opening. Bolt and lock washer assembly 134 passes through the outer or second leg of the panel engaging clip and bottoms out on the panel support flange as shown in FIG. 3. A bolt and lock washer assembly is provided about every 12 inches (0.3 meter) along the length of panel engaging clip. The procedure is repeated at the remaining sides of the panel to secure each side portion of the panel in position. The complete exterior of the building may be constructed having the panels mounted in position. Thereafter, weather permitting, work may be performed on the outside of the building to seal the exterior spacing between adjacent panels. For example, and with reference to FIG. 2, a polyurethane breaker 150 is inserted in the space between adjacent panels. Thereafter a silicone adhesive 152 such as the type used in the art, is inserted in the space. The curtainwall is now constructed. The curtainwall may be dressed in any convenient manner at the area adjacent the roof, street level or corner by modifying the design vertical and horizontal mullions. In addition, if desired, coverings designated by numeral 154 may be mounted over the portion of the vertical mullion visible from the interior of the building (see FIG. 2) and covering 156 may be used to cover the portion of the horizontal mullions (FIG. 3) visible from the building interior.

As can be appreciated, panels which are damaged or need to be replaced may be replaced in any convenient manner, e.g., by reversing the procedure in which the panels were mouned on the grid. Further, as can be appreciated, the invention is not limited to the specific design of the vertical mullion, horizontal mullion, the hangers or the panel clips and modifications may be made thereto without deviating from the spirit of the invention. For example, the panel engaging clips and hangers function to secure panels in position against the weatherstripping of the grid.

Figure 6:
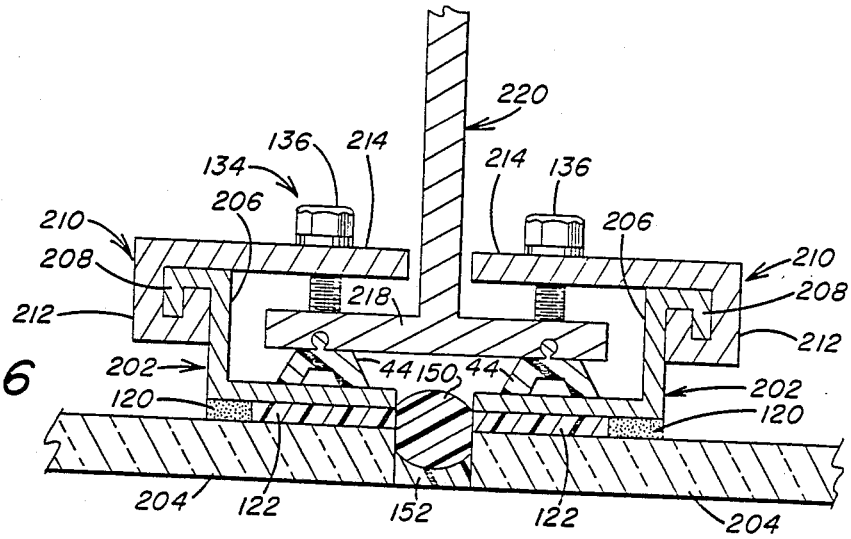
FIG. 6 is a fragmented plan view in cross-section illustrating an alternate embodiment of a hanger frame and panel clip arrangement of the invention for securing a panel on mullions.
Figure 7:
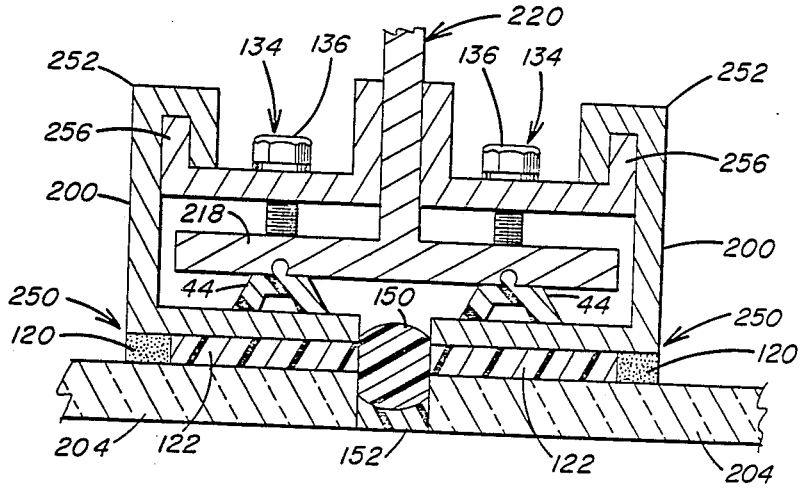
FIG. 7 is a view similar to that of FIG. 6 illustrating still a further embodiment of a hanger frame and panel clip arrangement of the invention for securing a panel on mullions.

With reference to FIGS. 6 and 7, there is shown alternate hanger and panel clip constructions that may be used in the practice of the invention. In FIG. 6, hangers sections 200 are arranged to form a hanger frame as previously discussed for hanger frame 112. The hanger section 200 in cross-section includes a leg 202 secured to panel 204 by the tape 120 and adhesive 122. Leg 206 extending away from the panel 204 as shown has one end connected to leg 202 and a hook 208 formed at the other end as shown in FIG. 6. Panel clip 210 has a hook end 212 interlocked with hook 208 and an arm 214 for receiving the bolt and lock washer assembly 134. Rotating the bolt 136 biases the leg 202 against the weatherstripping 44 secured in panel engaging flange 218 of mullion 220.

In FIG. 7, there is shown a panel clip 250 similar to clip 200 except the hook end 252 extends beyond the panel engaging flange 218 as shown in FIG. 7. Panel clip 254 has a generally "U" shaped cross-section having leg 256 in the groove of the hook end 252.

Figure 8:
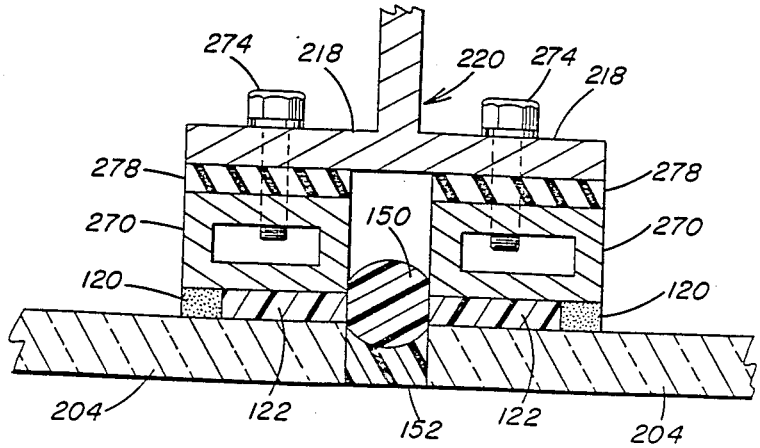
FIG. 8 is a fragmented plan view in cross-section illustrating an alternate embodiment of the invention for securing panels on mullions.

In FIG. 8, a hanger frame is made of tubular hanger sections 270 secured on the panel 204 by the tape 120 and adhesive 122. A screw 274 passes through the panel engaging flange 218 and hanger section 270 to bias or urge the hanger section against weatherstripping 278 to form a dust and water tight seal.

In the instance when vision panels having double glazed units are used with spandrel panels having a single glazing sheet, the difference in panel thickness is compensated for by increasing or decreasing the height of the leg 206 of the clips 200 and 250.

Although not limiting to the invention, modifications include mounting the weatherstripping 44 on the hanger frame in place of mounting the weatherstripping in the groove of the panel supporting member or replacing the groove of frame by an extending member and forming a groove on the end of the panel engaging clip. Further, the panel engaging clip may be secured to the grid by a screw passing through a leg of the clip into a mullion of the grid. The clip can take any cross-sectional configuration as long as a portion of the clip engages the hanger frame secured to the panel and the other portion of the clip engages the grid.

I claim:

1. A curtainwall for a structure, comprising:

a grid;

a glass panel having a first major surface, a second opposite major surface, and a peripheral edge connecting said major surfaces, the connection between said first major surface and said peripheral edge defining a peripheral perimemter corner;

an elongated hanger section having a groove;

adhesive securing said hanger section on said first major surface of said panel such that said hanger section terminates at or short of adjacent portion of said peripheral perimeter corner;

a panel clip having a portion inserted in said groove of said hanger section; and means engaging said clip and said grid and moveable relative to said clip for urging and maintaining said hangar section against said grid to secure said panel to said grid.

2. The curtainwall as set forth in claim 1 wherein said urging and maintaining means includes thread shaft threaded into a section of said clip.

3. The curtainwall as set forth in claim 1 wherein said panel has opposed peripheral perimeter corners with said hanger section at or terminating short of one peripheral perimeter corner and opening of said groove in said hanger section facing the opposite peripheral perimeter corner.

4. The curtainwall as set forth in claim 1 wherein said panel has opposed peripheral perimeter corners with said hanger section at or terminating short of one peripheral perimeter corner and opening of said groove in said hanger section facing a direction other than the peripheral perimeter corner.

5. The curtainwall as set forth in claim 1 wherein said hanger section is one of a plurality of hanger sections.

* * * * *